US006363638B1

(12) United States Patent
Liao

(10) Patent No.: US 6,363,638 B1
(45) Date of Patent: Apr. 2, 2002

(54) SIGNBOARD COMBINATION HAVING CHANGEABLE SIGNBOARDS

(76) Inventor: Shun I Liao, No. 19, Lane 154, Chong Ching Road, Taichung (TW)

( * ) Notice: Subject to any disclaimer, the term of this patent is extended or adjusted under 35 U.S.C. 154(b) by 0 days.

(21) Appl. No.: 09/500,949

(22) Filed: Jan. 15, 2000

(51) Int. Cl.[7] ..... G09F 11/32
(52) U.S. Cl. ..... 40/508; 40/470; 40/512
(58) Field of Search ..... 40/518, 509, 511, 40/512, 524, 537, 446, 470, 476, 471, 472

(56) References Cited

U.S. PATENT DOCUMENTS

| | | | | | |
|---|---|---|---|---|---|
| 844,344 | A | * | 2/1907 | Fletcher | 40/470 |
| 1,540,830 | A | * | 6/1925 | Davis | 40/509 |
| 1,716,582 | A | * | 6/1929 | Gilford | 40/476 |
| 1,847,069 | A | * | 3/1932 | Corrigan | 40/476 |
| 1,887,100 | A | * | 11/1932 | Littman | 40/511 |
| 2,793,452 | A | * | 4/1957 | Bustamante | 40/476 |
| 3,016,640 | A | * | 1/1962 | Swank | 40/476 |
| 3,222,807 | A | * | 12/1965 | Swank | 40/476 |
| 3,570,155 | A | * | 3/1971 | Moller et al. | 40/509 |
| 3,849,919 | A | * | 11/1974 | Gravelle et al. | 40/509 |

* cited by examiner

*Primary Examiner*—Lynne H. Browne
*Assistant Examiner*—Kenn Thompson
(74) *Attorney, Agent, or Firm*—Charles E. Baxley

(57) ABSTRACT

A signboard device includes a base having two chambers formed in the upper portion for slidably receiving a number of signboard holders. A driving member is disposed around the chambers of the base, and a spring-biased pusher is secured on the driving member and engaged with the signboards to move the signboards and the holders from one chamber to the other. A fence is disposed beside the chamber for engaging with and for urging the pusher to engage with the signboards or the holders. An eccentric stop is disposed for preventing the holders from moving backward.

14 Claims, 5 Drawing Sheets

SIGNBOARD COMBINATION HAVING CHANGEABLE SIGNBOARDS

BACKGROUND OF THE INVENTION

1. Field of the Invention

The present invention relates to a signboard combination, and more particularly to a signboard combination having changeable signboards.

2. Description of the Prior Art

Typical signboards are stably supported in place and may not be changed from each other.

The present invention has arisen to mitigate and/or obviate the afore-described disadvantages of the conventional signboards.

SUMMARY OF THE INVENTION

The primary objective of the present invention is to provide a signboard combination including a number of signboards that may be changed or replaced with each other.

In accordance with one aspect of the invention, there is provided a signboard combination comprising a base including an upper portion having a first chamber and a second chamber formed therein, at least one first holder received in the first chamber of the base, a signboard received in the first holder, and means for moving the first holder and the signboard from the first chamber to the second chamber of the base.

The moving means includes a driving member provided around the first chamber and the second chamber of the base, and a pusher secured on the driving member and engaged with the signboard to move the signboard and the first holder from the first chamber to the second chamber of the base. The moving means includes at least one fence provided beside the second chamber of the base, and means for biasing the pusher away from the signboard, the pusher includes an arm extended therefrom and engaged with the fence for moving the pusher, against the biasing means, to engage with and to push the signboard. The biasing means includes a spring coupled between the pusher and the driving member for biasing the pusher to a position parallel to the driving member and away from the signboard.

The fence includes a lead, the arm includes a wheel attached thereto and engaged with the lead for moving the pusher against the biasing means. The driving member is slidably received in a guide track which includes a slot formed therein, the pusher is pivotally secured to the driving member via a pivot shaft, the pivot shaft is extended outward through the slot of the guide track.

A limiting device is provided for limiting the first holder to move from the first chamber to the second chamber of the base and includes a stop pivotally secured to the base and engaged with the first holder to limit the first holder to move from the first chamber to the second chamber of the base and to prevent the first holder from moving backward from the second chamber to the first chamber of the base. The stop is pivotally secured to the base at an eccentric center and tilted to engage with the first holder.

At least one second holder is received in the second chamber of the base, a second signboard is received in the second holder, and means for moving the second holder and the second signboard from the second chamber to the first chamber of the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
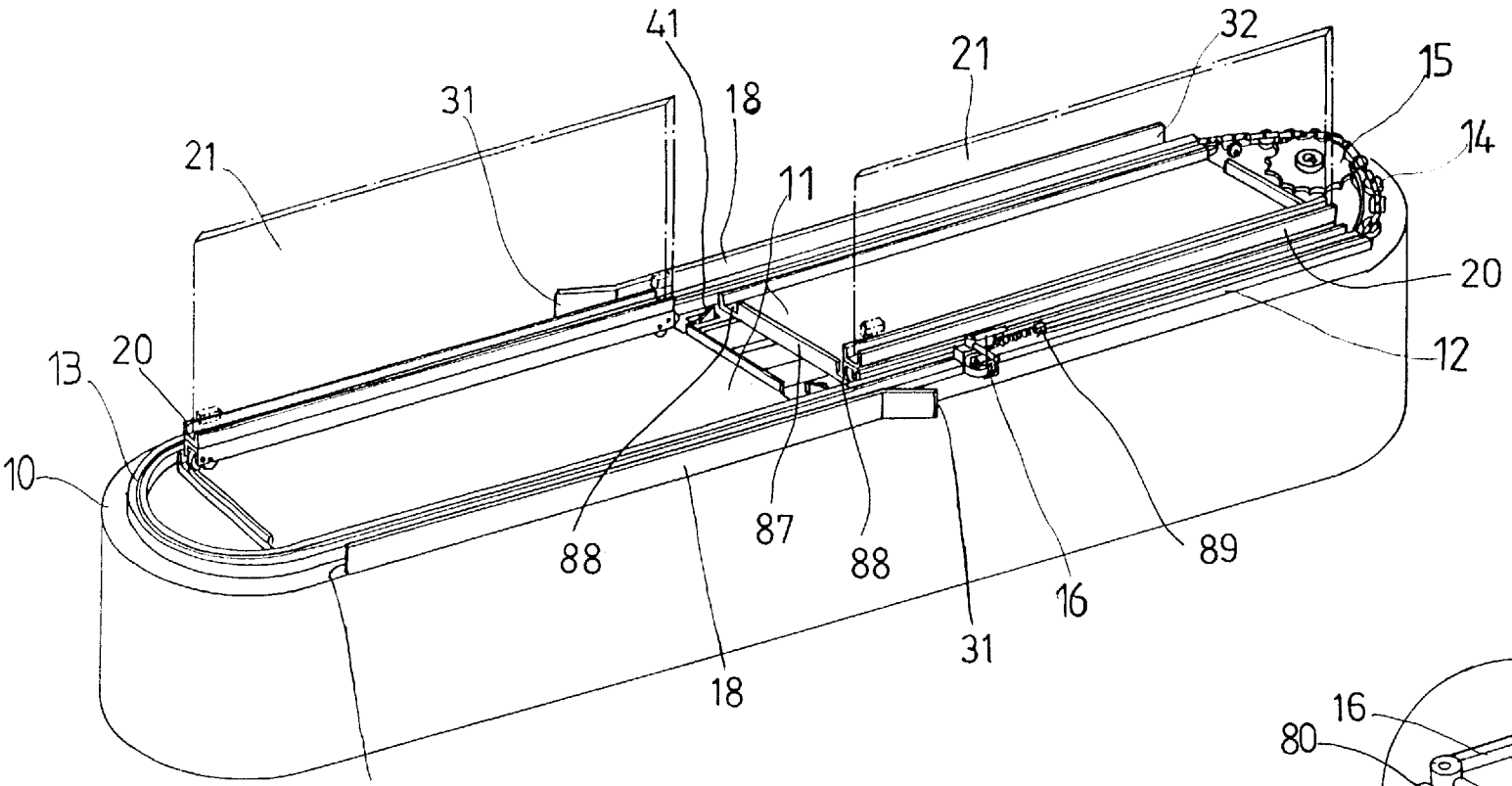
FIG. 1 is a perspective view of a signboard combination in accordance with the present invention.
Figure 2:
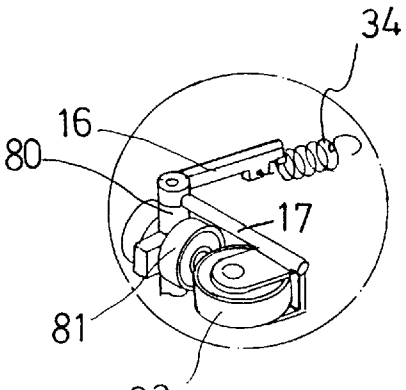
FIG. 2 is a partial perspective view of a spring-biased pusher for the signboards.
Figure 3:
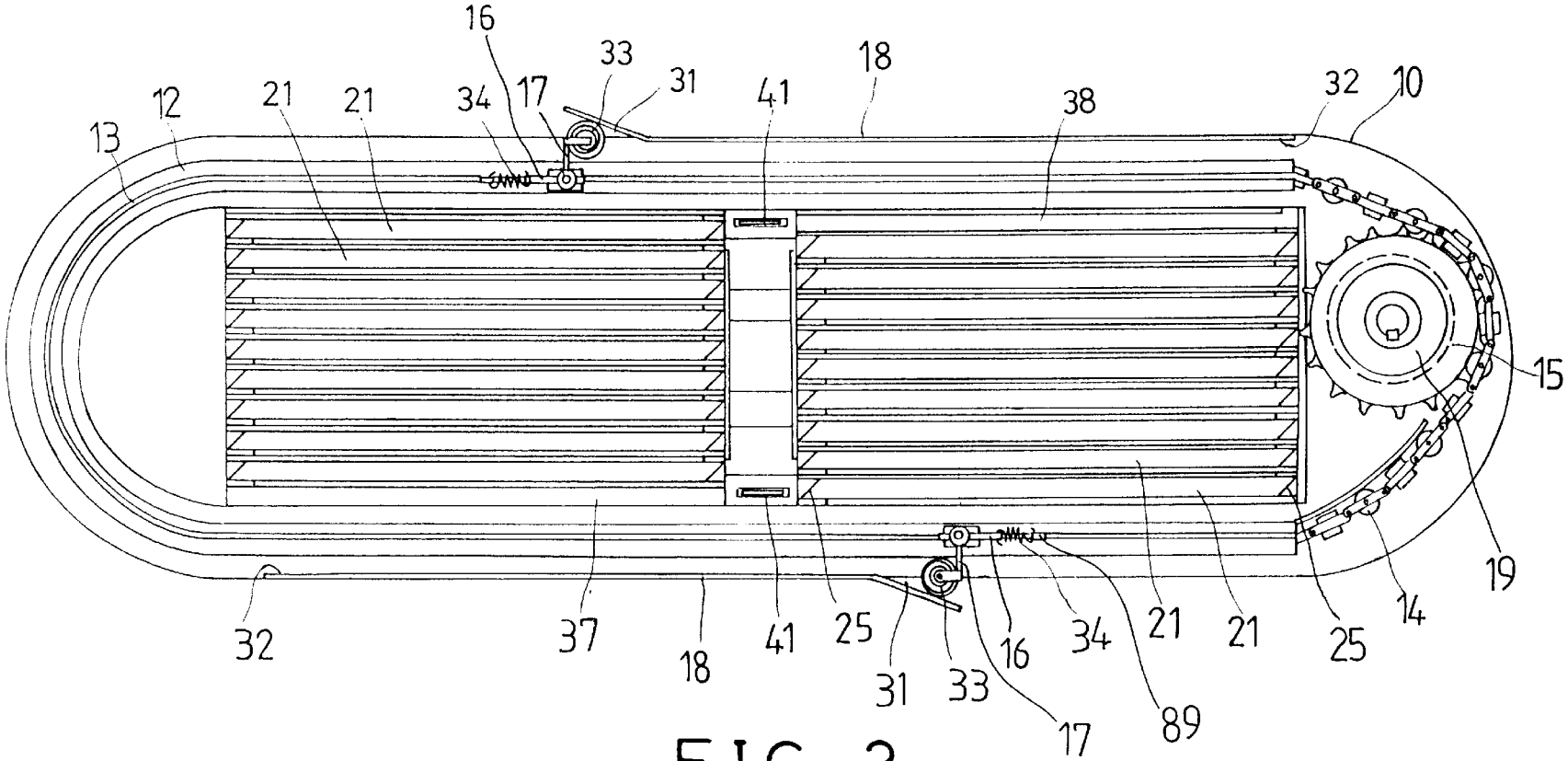
FIG. 3 is a top view of the signboard combination.
Figure 5:
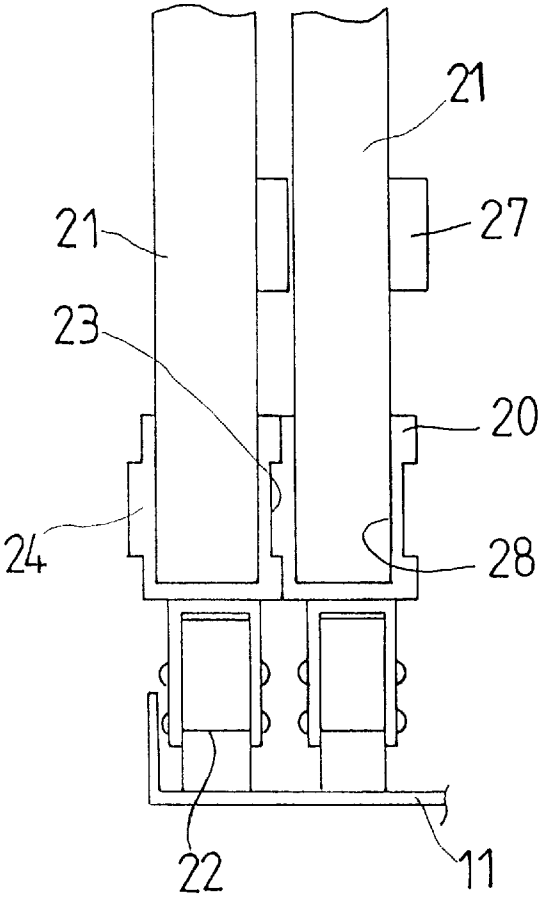
FIG. 5 is an enlarged partial side view of the signboard combination.

Referring to the drawings, and initially to FIGS. 1–3, a signboard combination in accordance with the present invention comprises a base 10 having two chambers 11 formed on the upper portion thereof and separated by one or more walls 87 for receiving signboard holders 20. The walls 87 each includes one or more notches 88 for allowing the holders 20 to be moved between the chambers 11 of the base 10. The holders 20 each has a groove 28 (FIG. 5) formed therein for receiving and securing the lower portion of the signboards 21, and each has one or more rollers 22 attached to the bottom portion thereof for moving between the chambers 11, and each has a depression 23 and a bulge 24 for mating or engaging with the corresponding bulge 24 or depression 23 of the other holders 20. The signboards 21 each has two tapered ends 25 formed therein and two end projections 27 (FIGS. 6, 7) extended laterally outward from the opposite sides thereof. The signboards 21 are flexible but having a strength to be erected for showing the advertisement applied onto either or both sides of the signboards 21.

A guide track 12 is disposed on the base 10 and provided around the chambers 11, and includes a slot 13 formed therein, particularly formed in the upper portion thereof. A driving member, such as a belt or a chain, 14 is slidably received in the track 12. A motor 19 is coupled to the driving member 14 directly or with a pulley-and-belt coupling device or a chain-and-sprocket coupling device 15 for rotating the driving member 14 around the track 12. One or two fences 18 are oppositely disposed on the base 10 and has a lead 31.

As shown in FIGS. 1–5, and as best shown in FIG. 2, a shaft 80 and a protrusion 89 are secured to the driving member 14 and extended outward of the track 12 via the slot 13. One or more rollers 81 are attached to the shaft 80 and slidably received in the track 12 for facilitating the sliding movement of the shaft 80 along the track 12. A pusher 16 is rotatably secured to the driving member 14 with the pivot shaft 80. A spring 34 is coupled between the pusher 16 and the protrusion 89 for biasing the pusher 16 to a position parallel to the driving member 14. The pusher 16 includes an arm 17 perpendicular to the pusher 16, and a wheel 33 is attached to the arm 17 for engaging with the fence 18 and the lead 31 (FIGS. 3, 4), and for rotating the pusher 16 to a position perpendicular to the track 12 against the spring 34. The pusher 16 may engage with the projection 27 of the signboard 21 to move the holder 20 between the chambers 11 of the base 10.

Figure 4:
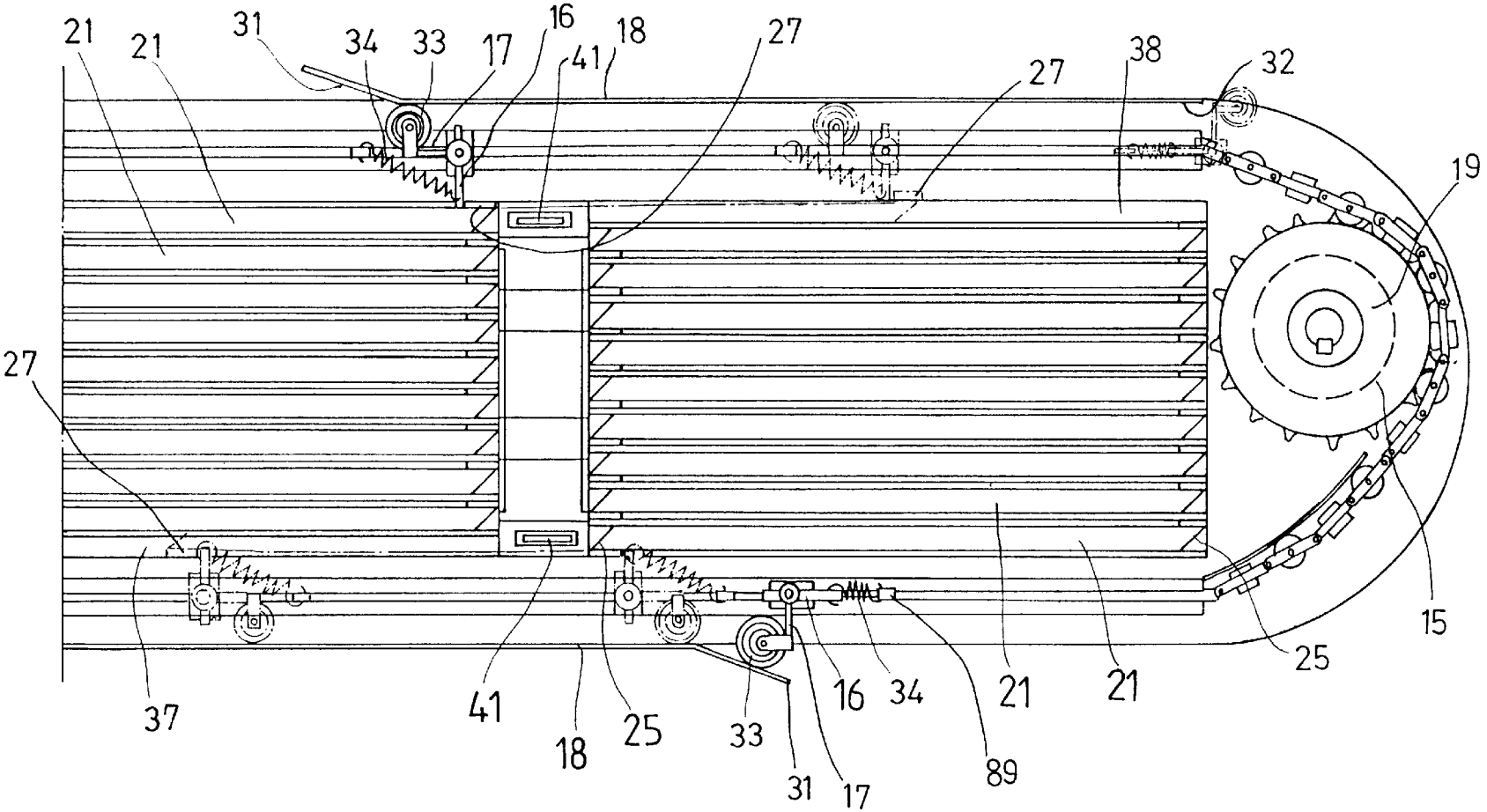
FIG. 4 is an enlarged partial top view illustrating the operation of the signboard combination.

In operation, as shown in FIGS. 3, 4, when the wheels 33 are engaged with the respective fences 18 via or after engaged with the leads 31 of the fences 18, the pusher 16 may be rotated, against the spring 34, from a position parallel to the driving member 14 and parallel to the guide track 12 to a position perpendicular to the guide track 12, best shown in FIG. 4, and the pusher 16 may thus be caused to engage with the projection 27 and to move the signboard 21 and the holder 20 from a first chamber 11 of the base 10 to the second chamber 11 of the base 10. The signboards 21 in the first chamber 11 may be moved toward a space 37, 38 (FIGS. 3, 4) in the other or the second chamber 11 by the tapered ends 25 of the signboards 21. The signboard 21 that is moved from the first chamber 11 (or from the second chamber 11) to the second chamber 11 (or to the first chamber 11) may leave a newly formed space 37, 38 in the first chamber 11 (or in the second chamber 11). The wheel 33 may be disengaged from the other end 32 of the fence 18, and the spring 34 may bias and disengage the pusher 16 from the projection 27 of the signboard 21. The holders 20 and the signboards 21 may thus be moved between the chambers 11. The signs or advertisements applied on the signboards 21 may thus be shown alternatively. When the pushers 16 are further moved forward by the driving member 14 to further push another signboard 21 from the first chamber 11 (or from the second chamber 11) to the second chamber 11 (or to the first chamber 11), the other signboards 21 may be moved toward the newly formed spaces 37, 38 and may form or leave the original places as another newly formed space 37, 38.

Figure 6:
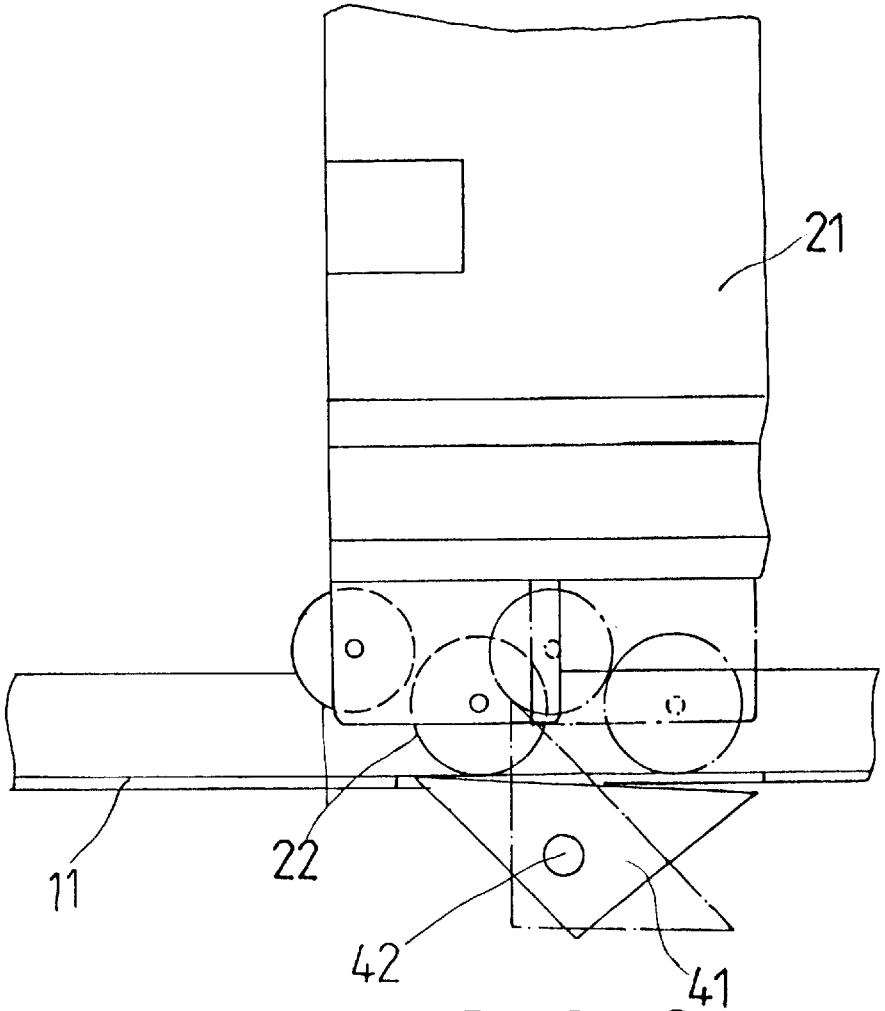
FIG. 6 is an enlarged partial front view of the signboard combination.
Figure 7:
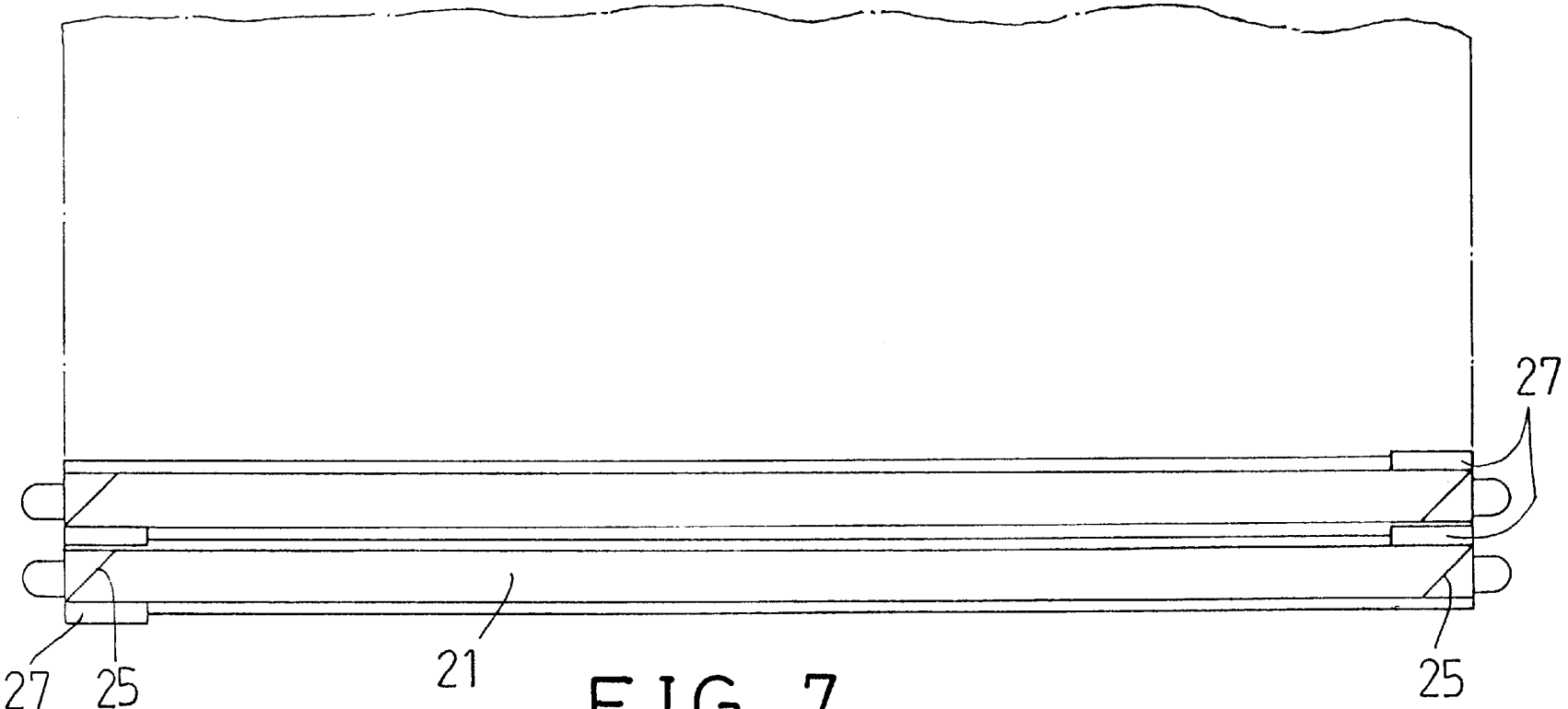
FIG. 7 is a top schematic view showing two of the signboards.

One or more stops 41 are pivotally secured in the base 10 with an eccentric pin 42, or the stops 41 have a center of gravity that is located off-center such that the stops 41 may be tilted and may engage with the holders 20, as shown in dotted lines in FIG. 6, to guide the holders 20 to move in one direction and to prevent the holders 20 from moving backward to the previous chamber 11.

Accordingly, the signboard combination in accordance with the present invention includes a number of signboards that may be changed or replaced with each other or alternatively.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A signboard combination comprising:

a base including an upper portion having a first chamber and a second chamber formed therein, at least one first holder received in said first chamber of said base, a signboard received in said at least one first holder, and means for moving said at least one first holder and said signboard from said first chamber to said second chamber of said base, said moving means including a driving member provided around said first chamber and said second chamber of said base, and a pusher secured on said driving member and engaged with said signboard to move said signboard and said at least one first holder from said first chamber to said second chamber of said base, said moving means including at least one fence provided beside said second chamber of said base, and means for biasing said pusher away from said signboard, said pusher including an arm extended therefrom and engaged with said at least one fence for moving said pusher, against said biasing means, to engage with and to push said signboard.

2. The signboard combination according to claim 1, wherein said biasing means includes a spring coupled between said pusher and said driving member for biasing said pusher to a position parallel to said driving member and away from said signboard.

3. The signboard combination according to claim 1, wherein said at least one fence includes a lead, said arm includes a wheel attached thereto and engaged with said lead for moving said pusher against said biasing means.

4. A signboard combination comprising:

a base including an upper portion having a first chamber and a second chamber formed therein, at least one first holder received in said first chamber of said base, a signboard received in said at least one first holder, means for moving said at least one first holder and said signboard from said first chamber to said second chamber of said base, said moving means including a driving member provided around said first chamber and said second chamber of said base, and a pusher secured on said driving member and engaged with said signboard to move said signboard and said at least one first holder from said first chamber to said second chamber of said base, and a guide track, said driving member being slidably received in said guide track, said guide track including a slot formed therein, said pusher being pivotally secured to said driving member via a pivot shaft, said pivot shaft being extended outward through said slot of said guide track.

5. The signboard combination according to claim 4 further comprising at least one roller attached to said pivot shaft and rollingly received in said guide track for facilitating a sliding movement of said pivot shaft along said guide track.

6. The signboard combination according to claim 1 further comprising means for limiting said at least one first holder to move from said first chamber to said second chamber of said base.

7. The signboard combination according to claim 6, wherein said limiting means includes a stop pivotally secured to said base and engaged with said at least one first holder to limit said at least one first holder to move from said first chamber to said second chamber of said base and to prevent said at least one first holder from moving backward from said second chamber to said first chamber of said base.

8. The signboard combination according to claim 7, wherein said stop is pivotally secured to said base at an eccentric center and tilted to engage with said at least one first holder.

9. The signboard combination according to claim 1 further comprising at least one second holder received in said second chamber of said base, a second signboard received in said at least one second holder, and means for moving said at least one second holder and said second signboard from said second chamber to said first chamber of said base.

10. The signboard combination according to claim 9, wherein said moving means includes a driving member provided around said second chamber and said first chamber of said base, and a pusher secured on said driving member and engaged with said second signboard to move said second signboard and said at least one second holder from said second chamber to said first chamber of said base.

11. A signboard combination comprising:

a base including an upper portion having a first chamber and a second chamber formed therein, at least one first holder received in said first chamber of said base, a signboard received in said at least one first holder, means for moving said at least one first holder and said signboard from said first chamber to said second chamber of said base, at least one second holder received in said second chamber of said base, a second signboard received in said at least one second holder, and a second moving means for moving said at least one second holder and said second signboard from said second chamber to said first chamber of said base, said second moving means including a driving member provided around said second chamber and said first chamber of said base, and a pusher secured on said driving member and engaged with said second signboard to move said second signboard and said at least one second holder from said second chamber to said first chamber of said base, said second moving means including at least one fence provided beside said first chamber of said base, and means for biasing said pusher away from said second signboard, said pusher including an arm extended therefrom and engaged with said at least one fence for moving said pusher, against said biasing means, to engage with and to push said second signboard, said biasing means including a spring coupled between said pusher and said driving member for biasing said pusher to a position parallel to said driving member and away from said second signboard, said at least one fence including a lead, said arm including a wheel attached thereto and engaged with said lead for moving said pusher against said biasing means.

12. The signboard combination according to claim 10, further comprising a guide track, said driving member being slidably received in said guide track, said guide track including a slot formed therein, said pusher being pivotally secured to said driving member via a pivot shaft, said pivot shaft being extended outward through said slot of said guide track, and means for limiting said at least one second holder to move from said second chamber to said first chamber of said base, said limiting means including a stop pivotally secured to said base and engaged with said at least one second holder to limit said at least one second holder to move from said second chamber to said first chamber of said base and to prevent said at least one second holder from moving backward from said first chamber to said second chamber of said base, said stop being pivotally secured to said base at an eccentric center and tilted to engage with said at least one second holder.

13. A signboard combination comprising:

a base including an upper portion having a first chamber and a second chamber formed therein, at least one first holder received in said first chamber of said base, a signboard received in said at least one first holder, means for moving said at least one first holder and said signboard from said first chamber to said second chamber of said base, and at least one wall disposed between said first chamber and said second chamber of said base, said at least one wall including a notch formed therein and aligned with said at least one first holder for allowing said at least one first holder to move from said first chamber to said second chamber of said base.

14. The signboard combination according to claim 9 further comprising at least one wall disposed between said first chamber and said second chamber of said base, said at least one wall including a pair of notches formed therein and aligned with said at least one first holder and said at least one second holder for allowing said at least one first holder to move from said first chamber to said second chamber and for allowing said at least one second holder to move from said second chamber to said first chamber of said base.

* * * * *